US008267804B1

(12) United States Patent
Tsai

(10) Patent No.: US 8,267,804 B1
(45) Date of Patent: Sep. 18, 2012

(54) GAME TABLE WITH HOCKEY GAME

(75) Inventor: Lore Tsai, Taichung (TW)

(73) Assignee: Zhejiang Elephant Sport Co., Ltd., Jiashan, Zhejiang (CN)

( * ) Notice: Subject to any disclaimer, the term of this patent is extended or adjusted under 35 U.S.C. 154(b) by 10 days.

(21) Appl. No.: 13/117,226

(22) Filed: May 27, 2011

(51) Int. Cl.
*A63D 15/04* (2006.01)
*A63F 7/06* (2006.01)

(52) U.S. Cl. ..... 473/14; 473/10; 273/126 A

(58) Field of Classification Search ..... 273/108.1, 273/126 A; 473/10, 14
See application file for complete search history.

(56) References Cited

U.S. PATENT DOCUMENTS

| | | | | |
|---|---|---|---|---|
| 6,109,607 | A * | 8/2000 | Cartwright et al. | 273/108.1 |
| 6,347,797 | B1 * | 2/2002 | Tsai | 273/309 |
| 6,349,939 | B1 | 2/2002 | Tsai | |
| 6,419,224 | B1 * | 7/2002 | Tsai | 273/108.1 |
| 6,764,409 | B1 * | 7/2004 | Voden | 473/10 |
| 7,762,902 | B2 * | 7/2010 | Voden | 473/10 |
| 7,785,208 | B2 | 8/2010 | Voden | |
| 7,967,693 | B1 * | 6/2011 | Voden | 473/10 |
| 7,967,694 | B2 * | 6/2011 | Voden | 473/10 |
| 7,972,219 | B1 * | 7/2011 | Voden | 473/10 |
| 7,972,220 | B2 * | 7/2011 | Voden | 473/10 |
| 7,976,397 | B2 * | 7/2011 | Voden | 473/10 |
| 2004/0132536 | A1 * | 7/2004 | Voden | 473/10 |
| 2004/0132537 | A1 * | 7/2004 | Voden | 473/10 |
| 2005/0049056 | A1 * | 3/2005 | Padilla | 473/10 |
| 2005/0064945 | A1 * | 3/2005 | Voden | 473/10 |
| 2005/0104294 | A1 * | 5/2005 | Chen | 273/309 |
| 2005/0202884 | A1 * | 9/2005 | Voden | 473/10 |
| 2005/0250589 | A1 * | 11/2005 | Voden | 473/4 |
| 2005/0255928 | A1 * | 11/2005 | Nally | 473/10 |
| 2008/0051206 | A1 * | 2/2008 | Voden | 473/14 |
| 2008/0227557 | A1 * | 9/2008 | Voden | 473/14 |
| 2009/0305801 | A1 * | 12/2009 | Chung | 473/14 |
| 2011/0237338 | A1 * | 9/2011 | Voden | 473/14 |

* cited by examiner

*Primary Examiner* — Raleigh W. Chiu
(74) *Attorney, Agent, or Firm* — Guice Patents PLLC

(57) ABSTRACT

A game table includes: a table body having two end frames; a table board rotatably connected between the two end frames, the table board having a hockey table face in which an air space is formed; an air-blowing member mounted in one of the end frames for blowing air into a pressure reservation space, after the pressure is reserved in the pressure reservation space, the air flowing into the air space and then flowing out the hockey table face through orifices thereof; and multiple flow guide units disposed in the air space to partition the air space into multiple flow ways. The flow guide units and the flow ways communicate with each other, whereby the air can uniformly flow to every part of the air space without generating turbulence and with the air pressure unified over the air space to enhance blowing effect of the hockey table face.

20 Claims, 12 Drawing Sheets

GAME TABLE WITH HOCKEY GAME

BACKGROUND OF THE INVENTION

1. Field of the Invention

The present invention relates generally to a game table for playing a sport game, and more particularly to a game table having a rotatable table board with a hockey game.

2. Description of the Related Art

There is a conventional game table with a rotatable table board. The table board is pivotally mounted on a table body. Two table faces of the table board are respectively formed with two different games such as a pool table face and a hockey table face. Accordingly, the game table can provide at least two sport games for players to play.

When playing hockey game with the conventional game table, air is blown out of the hockey table face for reducing frictional force between the puck and the hockey table face and enhancing sliding movement of the puck thereon. A common structure to such conventional game table is that the table board is formed with a space therein, and numerous small orifices are densely distributed over the hockey table face. A fan is used to blow air into the space. The air can flow out of the hockey table face through the orifices to create floating effect.

The applicant's U.S. Pat. No. 6,374,797 discloses a game table with using modes convertible by way of rotation. In this game table, a fan is mounted at one end of the table body for blowing air into a space of the table board. After blown into the space, the air flows out of the hockey table face of the table board through the orifices of the hockey table face.

U.S. Pat. No. 7,762,902 discloses a rotary game table in which a fan is directly disposed in the table board to blow air out of the hockey table face through the orifices.

Both the game tables of the above two patents have some defects. First, the air space formed in the table board is a totally wide space with a considerably large capacity and there is no buffering or pressure reservation medium between the fan and the space. Therefore, when the air is blown into the space by the fan, the air will rapidly expand to abruptly reduce the wind pressure. The farther the place is away from the fan, the more quickly the pressure of the place is reduced. In this case, the wind pressure indifferent positions of the space can be hardly unified. The large pressure difference causes the air to flow out from the orifices in specific positions. As a result, it is impossible to provide a uniform floating effect on the hockey table face.

Moreover, in the conventional structure, no flow guide design is arranged in the space of the table board. Therefore, the air blown into the space tends to cause turbulence in the space. This leads to poor flowing efficiency of the air and interference between airflows. As a result, the air can hardly flow over the entire space. Also, the turbulence makes it hard for the air to flow out from the orifices.

In addition, another conventional game table is shown in FIGS. 1 to 4 of the applicant's U.S. Pat. No. 6,419,224, which is not designed with any rotary mechanism and the fan thereof is inadaptable to a rotary game table. Although multiple wind-guiding channels are arranged in the game table, the wind-guiding channels are independent from each other so that the airflows cannot flow between the wind-guiding channels to supplement wind pressure to each other, and the wind pressure of the ends of the wind-guiding channels will quickly drop. Furthermore, in this conventional structure, the fan is installed in an air room member, which has a wide internal space. After the air goes into the air room member, the wind pressure will rapidly drop, and turbulence will be occurred in the air room member too. Therefore, the using effect of such structure is also poor.

SUMMARY OF THE INVENTION

It is therefore a primary object of the present invention to provide a game table with hockey game. The game table has a hockey table face and an air-blowing member for blowing air out of the hockey table face. The present invention promotes the air in the game table at high flowing efficiency, and enhances an excellent air-blowing effect on the hockey table face.

To achieve the above and other objects, the game table of the present invention includes: a table body having two end frames; a table board pivotally connected between the two end frames and rotatable, the table board having a hockey table face, the hockey table face having a face board and an inner board; numerous orifices being densely distributed over the face board; an air space being defined between the face board and the inner board; multiple inlets being formed on the inner board in communication with the air space; an air-blowing member mounted in one of the end frames for blowing air into the air space and making the air flow out of the face board through the orifices;

a pressure reservation space positioned between the air space and the air-blowing member, the air being first blown by the air-blowing member into the pressure reservation space and then flowing into the air space, the pressure reservation space serving to reserve air pressure, whereby the air still has wind pressure when flowing into the air space, the pressure reservation space also serving to guide the air to flow from the inlets of the inner board into the air space without generating turbulence; and multiple flow guide units disposed in the air space to partition the air space into multiple flow ways; the flow guide units and the flow ways communicate with each other to form airflow paths, whereby the air can efficiently flow within the air space without generating turbulence. Moreover, the air can flow to every part of the air space to unify the wind pressure over the air space. Accordingly, a uniform air-blowing effect on the hockey table face is obtained.

Each flow guide unit has at least one air guide channel in alignment with a row of orifices. The air can flow through the air guide channel and flow out from the orifices.

The present invention can be best understood through the following description and accompanying drawings, wherein:

DETAILED DESCRIPTION OF THE PREFERRED EMBODIMENT

Figure 1:
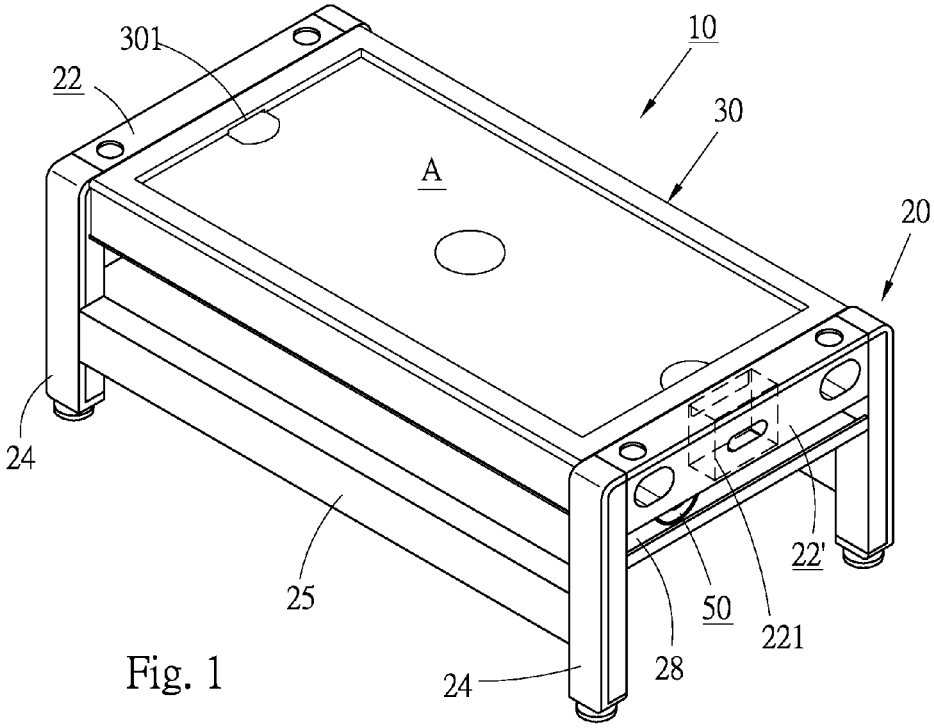
FIG. 1 is a perspective assembled view of a preferred embodiment of the present invention, showing the first game table face.
Figure 2:
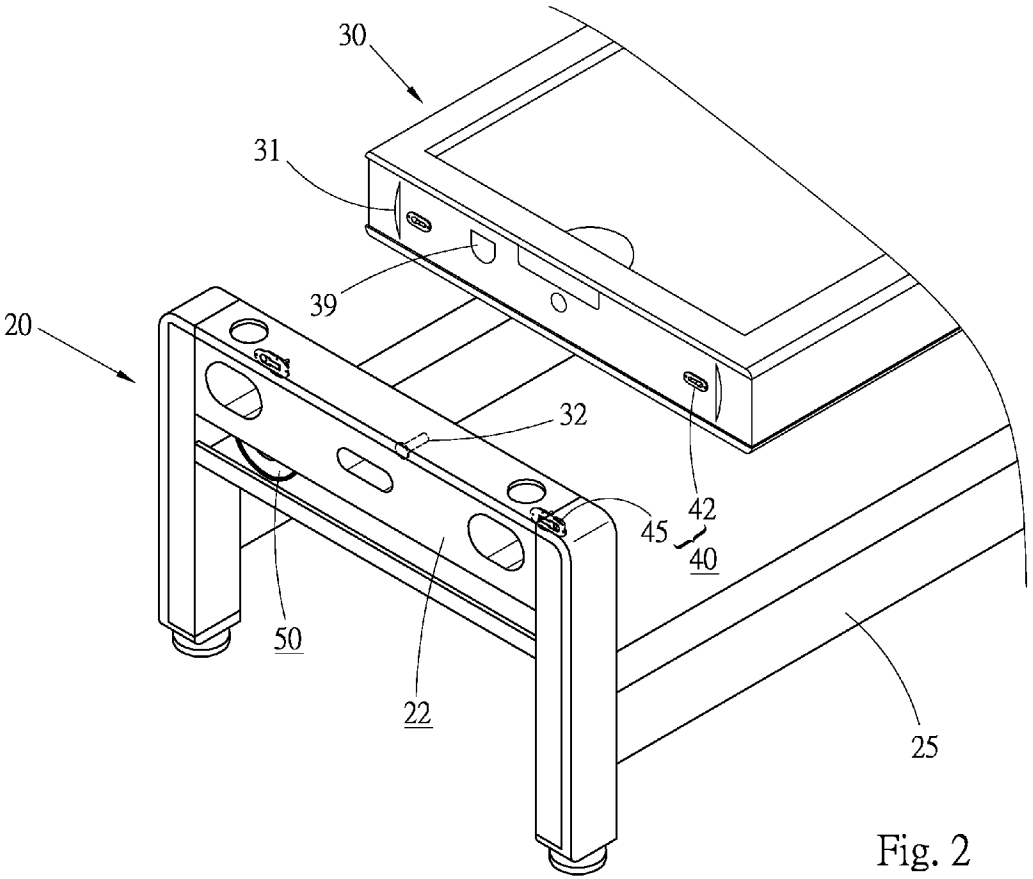
FIG. 2 is a perspective partially exploded view of the preferred embodiment of the present invention according to FIG. 1.
Figure 3:
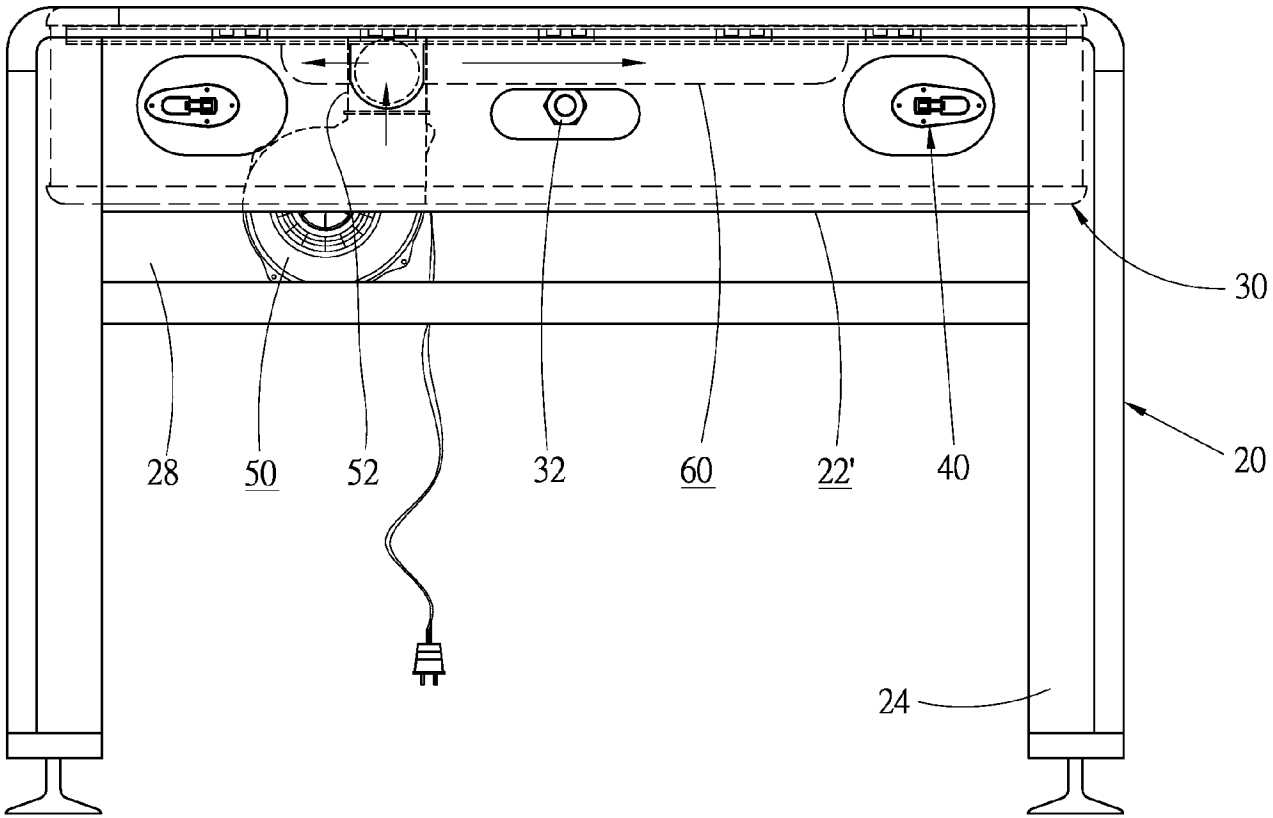
FIG. 3 is an end view of the preferred embodiment of the present invention according to FIG. 1.

Please refer to FIGS. 1 to 3, according to a preferred embodiment, the game table 10 of the present invention includes a table body 20 and a rotatable table board 30 pivotally mounted on the table body 20.

The table body 20 has two end frames 22 each having two table legs 24 on two sides. The table legs of the end frames 22 are connected by means of two connection beams 25.

Figure 5:
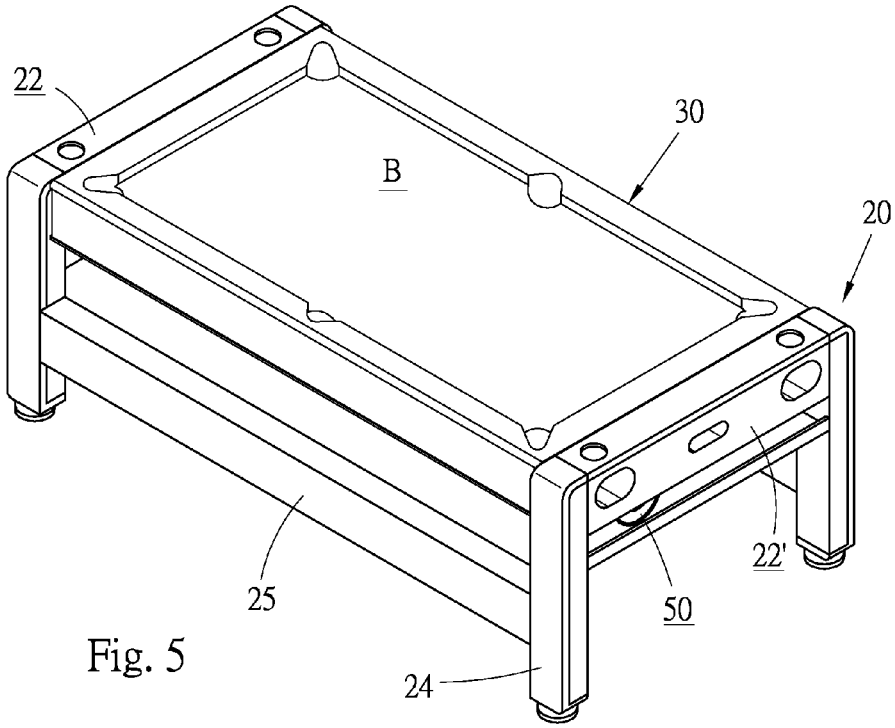
FIG. 5 is a perspective assembled view of the preferred embodiment of the present invention, showing the second game table face.
Figure 4:
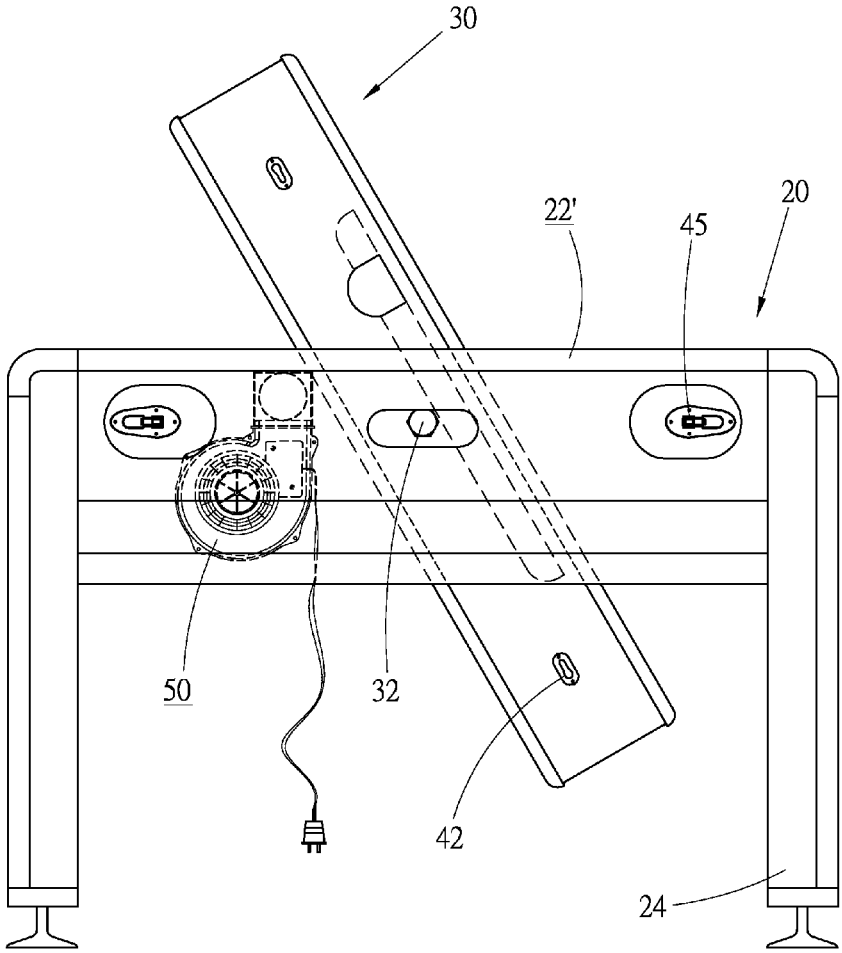
FIG. 4 is an end view according to FIG. 3, showing that the table board is rotated.

The table board 30 is a rectangular frame body with a certain thickness. Two ends of the table board 30 are respectively pivotally connected with the end frames 22 via two pivot pins 32, whereby the table board 30 is rotatably mounted on the table body 20 as shown in FIG. 4. The top face and bottom face of the table board are formed with a hockey table face A and a second game table face B. The second game table face B can be a pool table face or any other game table face as shown in FIG. 5.

Figure 6:
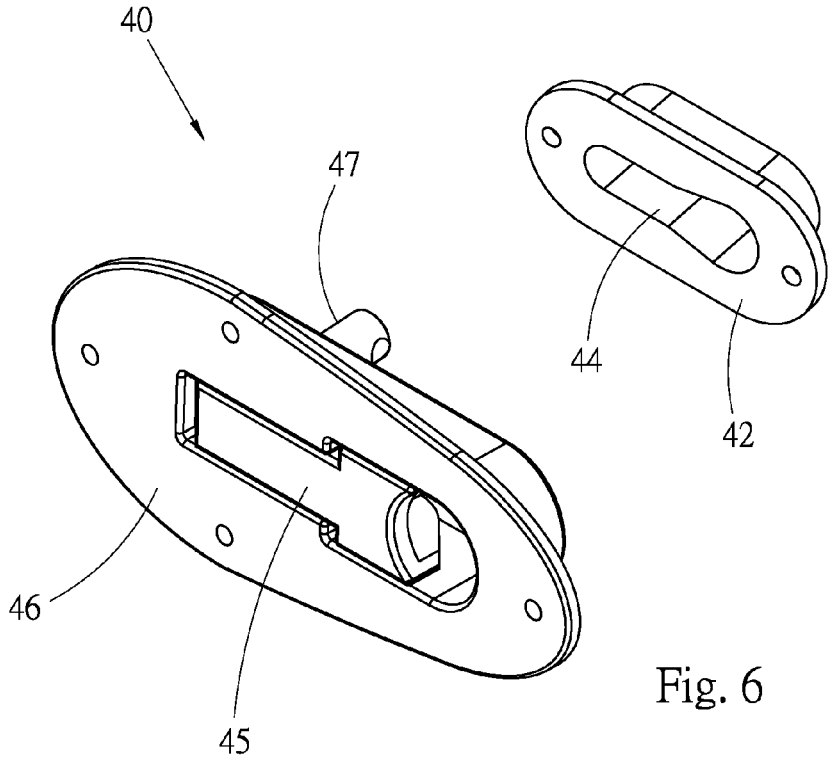
FIGS. 6 and 7 are perspective views of the latch assembly of the preferred embodiment of the present invention.
Figure 7:
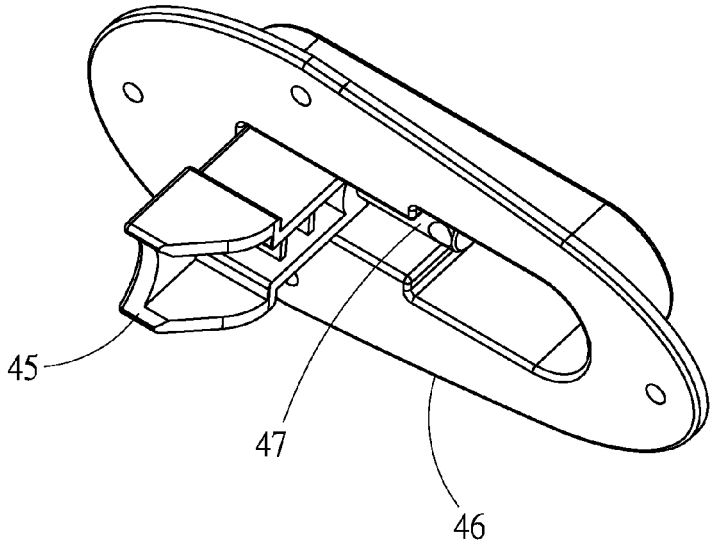

Multiple latch assemblies 40 are mounted between the table body and the table board. As shown in FIGS. 6 and 7, each latch assembly 40 includes a first latch member 42 and a second latch member 45. The first latch member 42 is mounted on an end face of the table board 30, while the second latch member 45 is pivotally disposed in a case 46. The case 46 is mounted on the end frame 22 so that the second latch member 45 is installed on the end frame. A bolt 47 is connected with one end of the second latch member 45. When the table board 30 is rotated into a horizontal position, the second latch member 45 is turned and shifted to a latching position as shown in FIG. 6, whereby the bolt 47 is moved and positioned in a slot 44 of the first latch member 42 to fix the table board and prevent the table board from rotating. When the second latch member 45 is turned and shifted to a releasing position as shown in FIG. 7, the bolt 47 is moved out of the first latch member 42. Under such circumstance, a user can rotate the table board 30 to use the different game table face. The latch assembly is not limited to the structure in this embodiment and can have any other form. In addition, the end face of the table board 30 is provided with soft bar members 31 as shown in FIG. 2. By the soft bar members 31, the table board 30 is inelastic contact with the end frame 22 without loosening.

Figure 8:
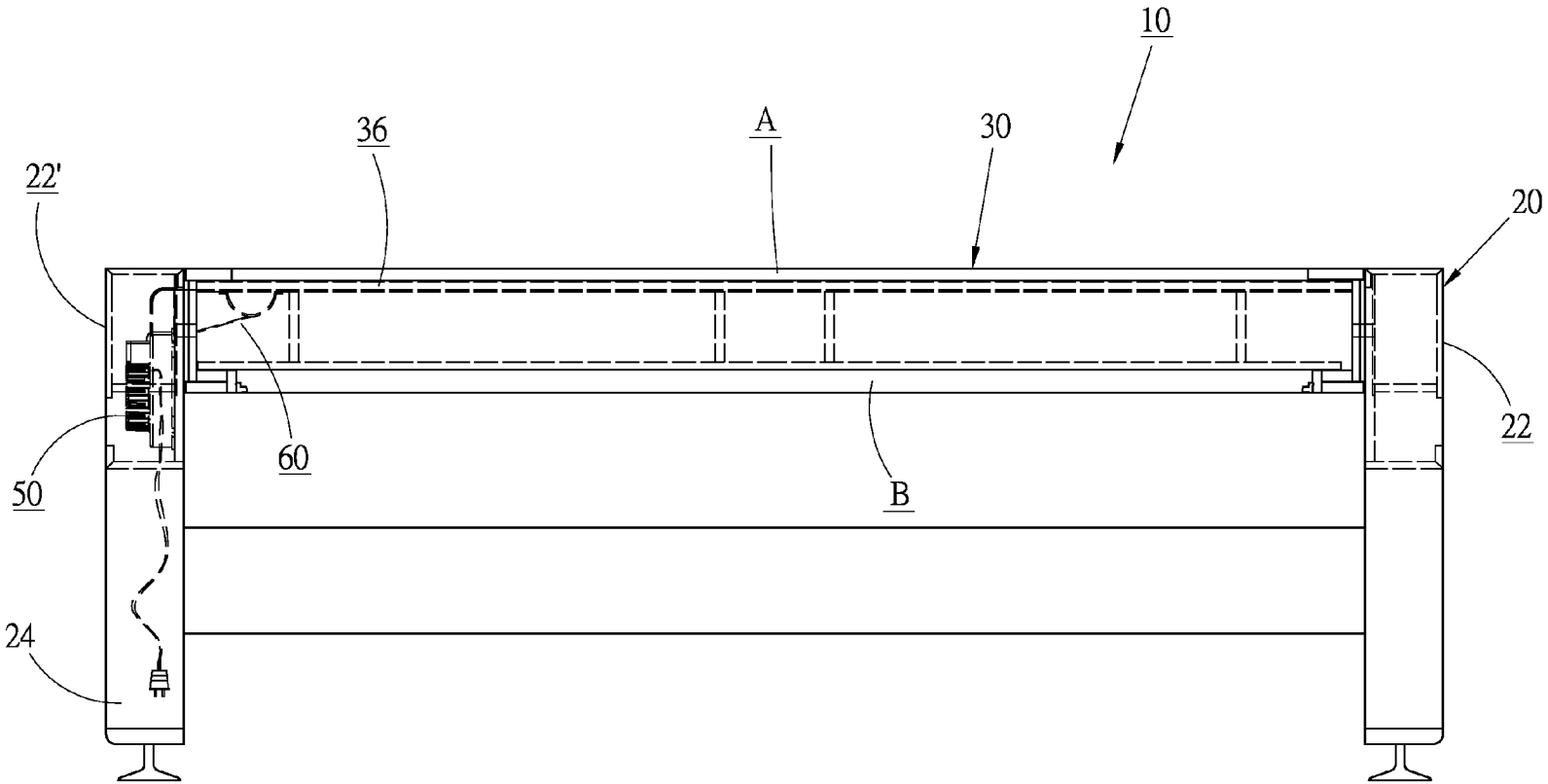
FIG. 8 is a side view of the preferred embodiment of the present invention according to FIG. 1.
Figure 9:
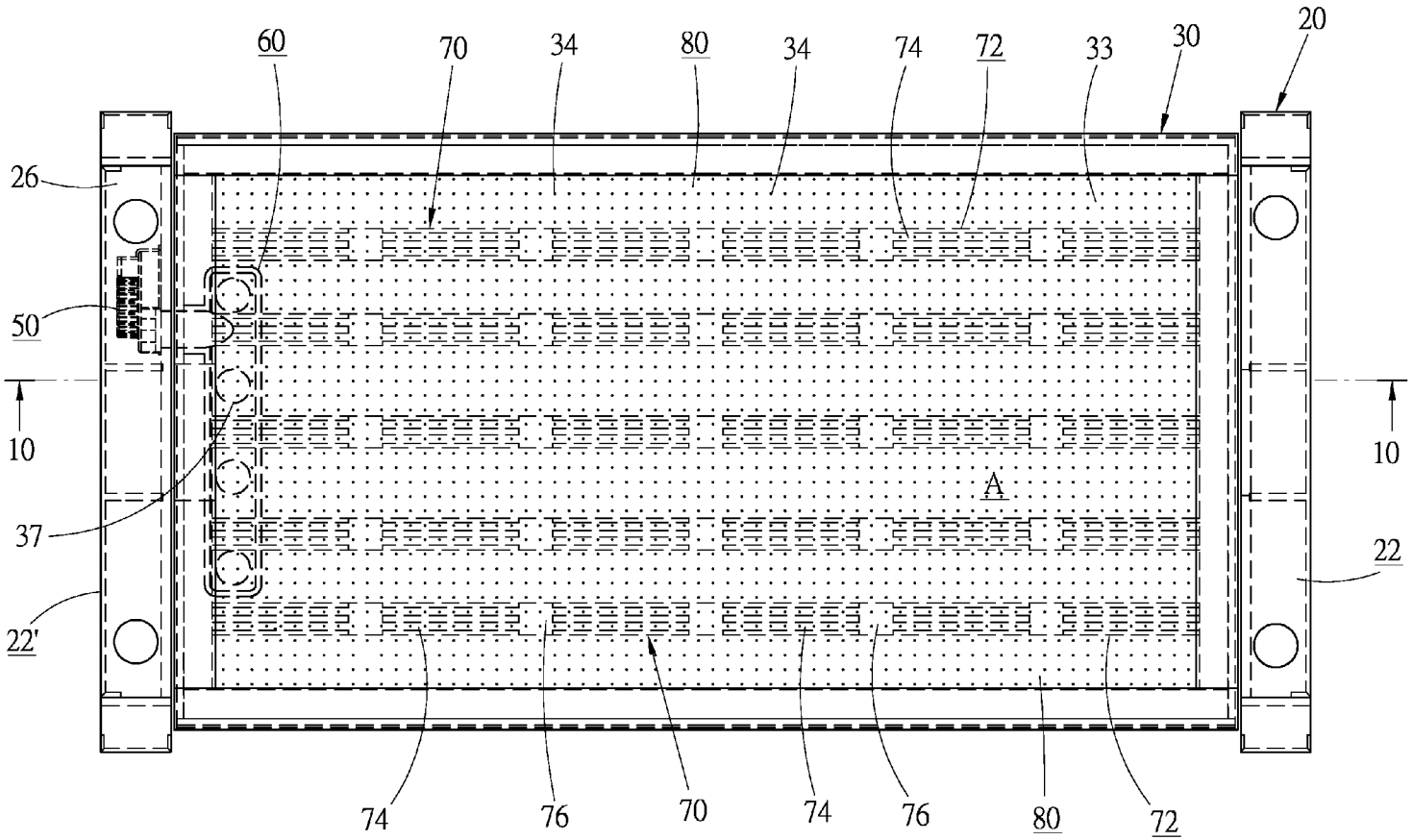
FIG. 9 is a top view of the preferred embodiment of the present invention according to FIG. 1.

The present invention will be described hereinafter with reference to FIG. 8, in which the table board 30 is positioned in a state for using the hockey table face A. Please refer to FIGS. 9 and 10. The hockey table face A of the table board 30 has a playing face board 33. Numerous small orifices 34 are longitudinally and transversely arranged on and densely distributed over the face board 33. An inner board 35 is disposed in the table board 30 and spaced from the face board 33 by an air space 36, the air space 36 is defined between the face board 33 and the inner board 35. Air can go into the space 36 from one end thereof. Multiple inlets 37 are formed at an end of the inner board 35 for air to flow into the space 36 as shown in FIG. 11. The inlets 37 are adjacent to the end of the table board and arranged in a row from one side to the other side of the table board.

An air-blowing member 50, which in this embodiment is, but not limited to, a blower, has an air exit 52. The blower serves to collectively blow out air from the air exit 52. The blower 50 is mounted in a receiving space 26 formed in a first end frame 22' of the table body and concealed in the first end frame 22' for blowing air into the air space 36. The air exit 52 is positioned at a first vent 27 formed on an inner wall of the end frame 22'. An outer wall of the end frame 22' is formed with an opening 28 for the blower to suck air in.

Figure 10:
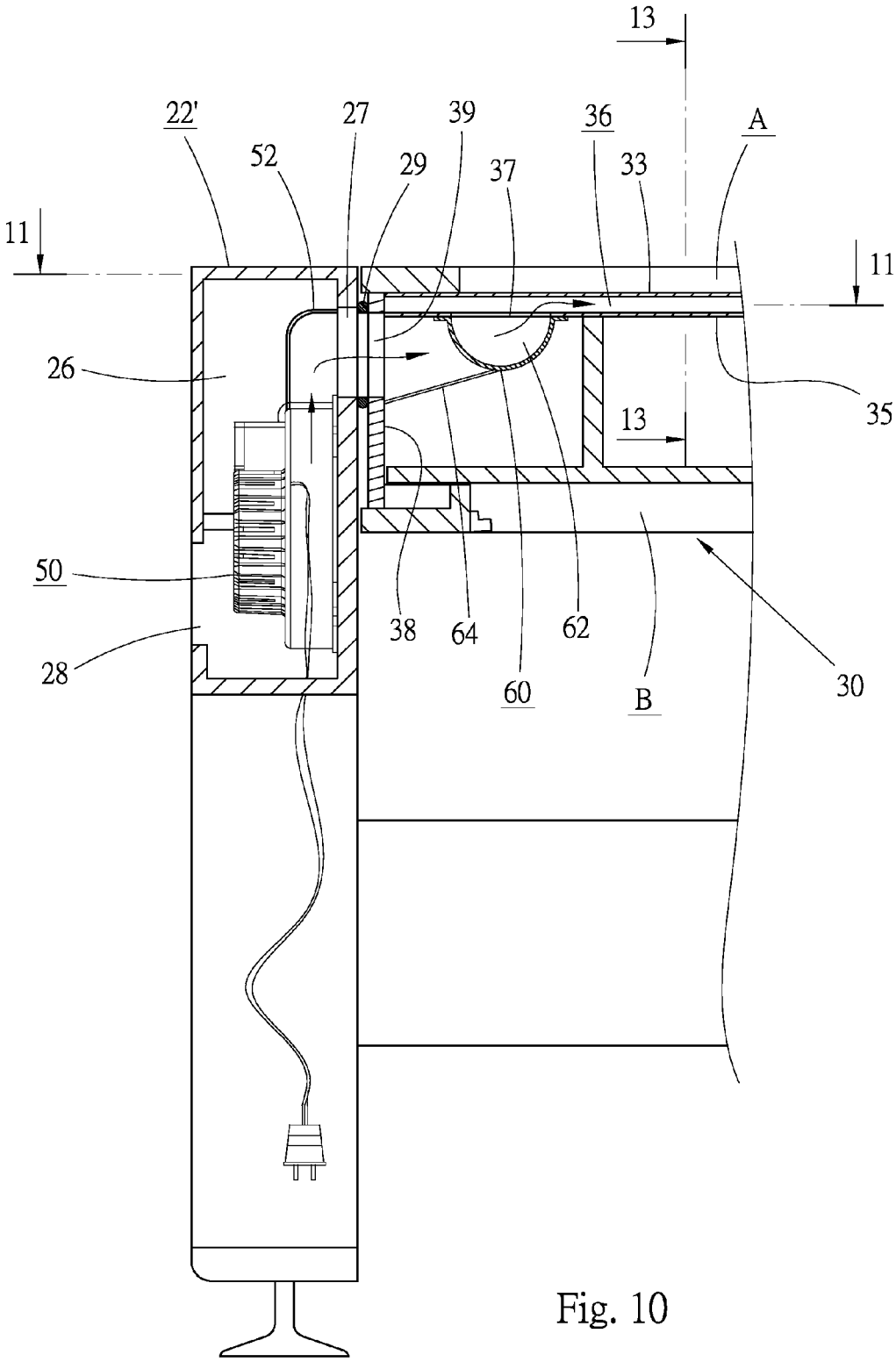
FIG. 10 is a sectional view taken along line 10-10 of FIG. 9.
Figure 11:
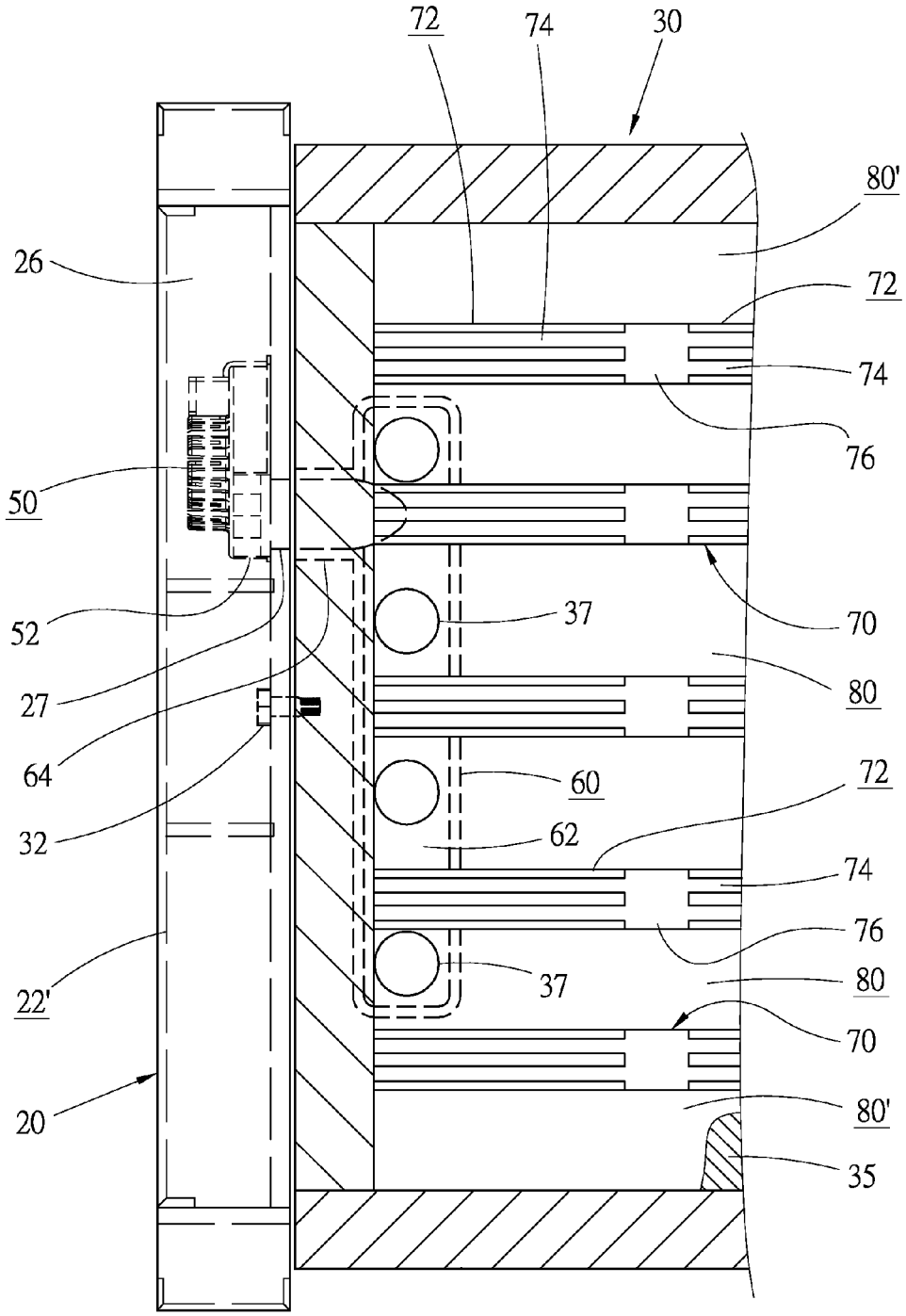
FIG. 11 is a top sectional view taken along line 11-11 of FIG. 9, in which the face board of the game table is removed.
Figure 12:
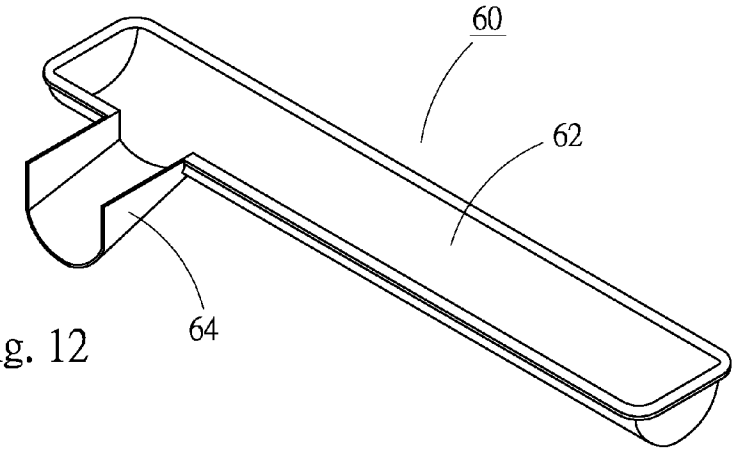
FIG. 12 is a perspective view of the air reservoir member of the preferred embodiment of the present invention.

Please refer to FIGS. 10 to 12, an air reservoir member 60, which is an elongated case with an open top face. The air reservoir member 60 has a pressure reservation space 62 therein. An intake, which is an intake manifold 64, is disposed on a front edge of the air reservoir member 60. The air reservoir member 60 is mounted in the table board 30 and sealedly connected with a bottom face of the inner board 35. The air reservoir member 60 also covers the inlets 37 of the inner board 35. Please refer to FIG. 10, a free end of the intake manifold 64 is positioned at a second vent 39 formed on the end board 38 of the table board 30. The vent 27 of the end frame 22' is aligned with the vent 39 of the end face of the table board 30. An airtight member 29 such as a soft rubber gasket can be disposed between the two vents 27, 39 to avoid leakage of air from the gap between the two vents.

Figure 13:
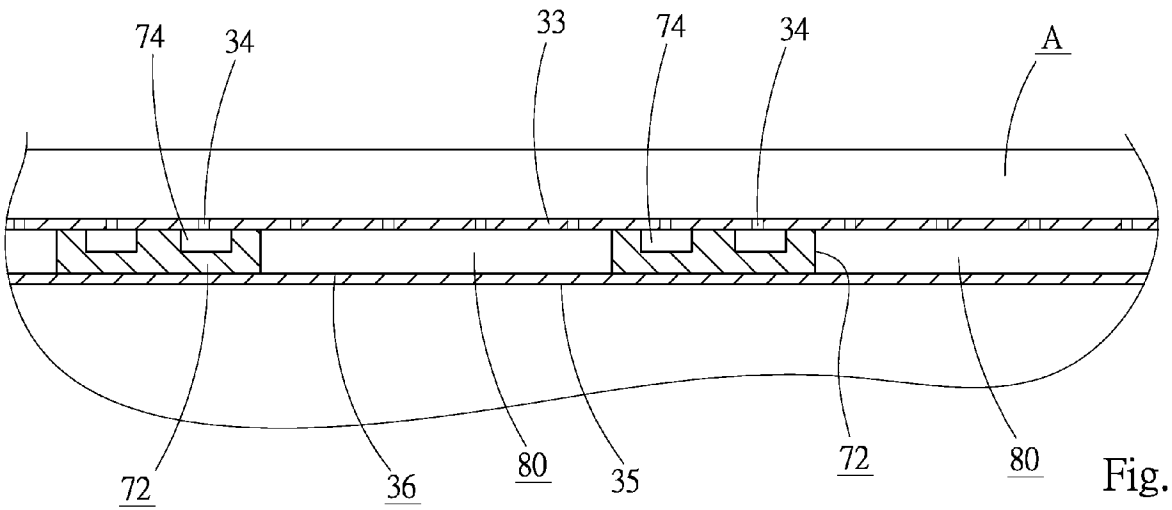
FIG. 13 is a sectional view taken along line 13-13 of FIG. 11.

Multiple flow guide units, which have elongated configurations. The flow guide units are mounted in the air space 36 and arranged in rows. Each flow guide unit extends from one end of the hockey table face A to the other end thereof. The flow guide units partition the air space 36 into multiple rows of flow ways 80 as shown in FIGS. 11 and 13. In this embodiment, there are five flow guide units and six flow ways 80. The top face of each flow guide unit is longitudinally formed with at least one air guide channel 74, preferably each air guide channel 74 is in alignment with a row of orifices 34. Each flow guide unit is also formed with multiple open passageways 76 arranged at intervals for air to flow therethrough.

To speak more specifically, each flow guide unit has multiple flow guide bodies 72 arranged from one end of the table board to the other end thereof. The top face of each flow guide body 72 is formed with at least one air guide channel 74, for example, two air guide channels 74. Each air guide channel 74 is aligned with a row of orifices 34. An interval is defined between each two forward and rearward adjacent flow guide bodies 72 as the passageways 76.

Referring to FIG. 11, in the air space, five flow guide bodies 72 and six flow ways 80 are alternately arranged. The air space 36 is provided with four inlets 37 in communication with the middle four flow ways 80 respectively. Neither of the outermost two flow ways 80' is in communication with any inlet 37. The flow guide bodies 72 are such positioned as not to block any inlet.

Figure 14:
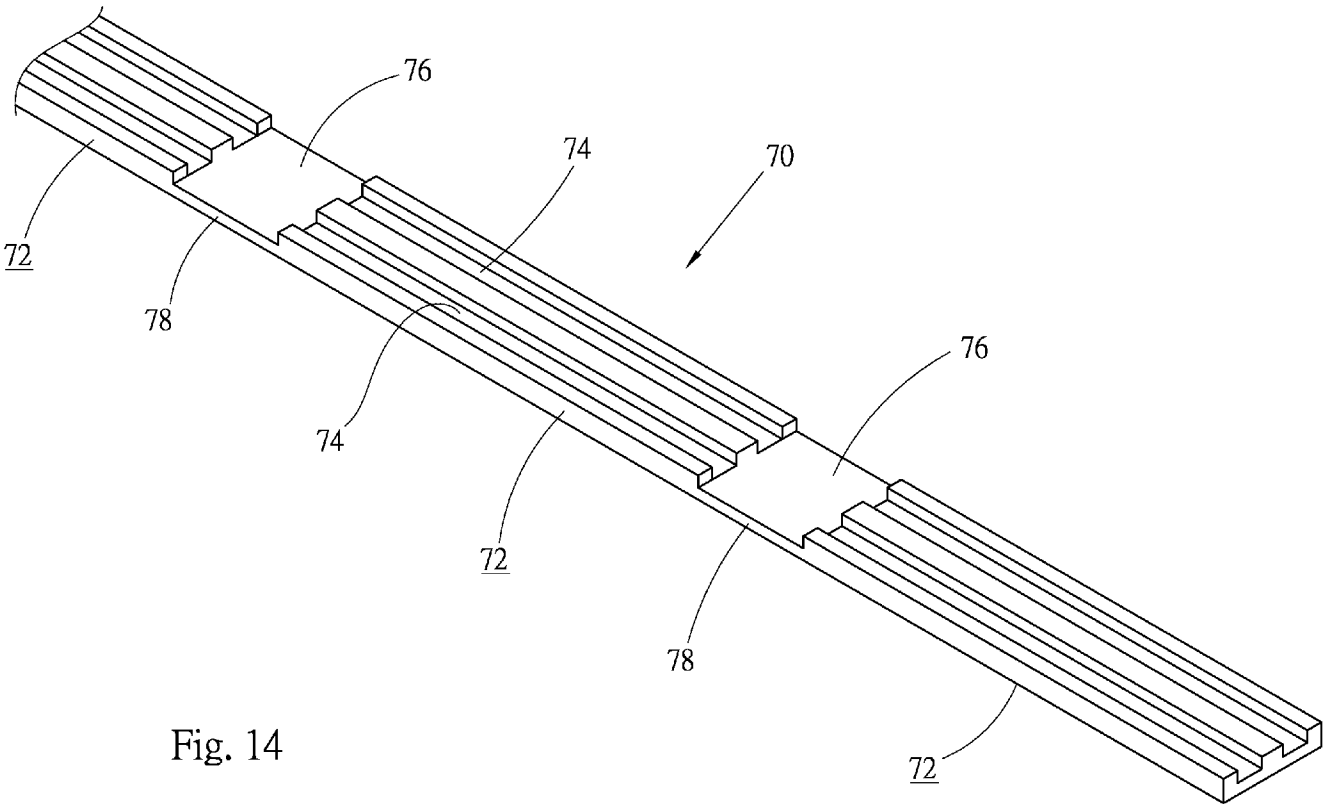
FIG. 14 is a perspective view of the flow guide member of the preferred embodiment of the present invention.

In practice, referring to FIG. 14, each flow guide unit is made from an elongated flow guide member 70. The flow guide member 70 is formed with multiple recesses arranged at suitable intervals as the passageways 76 to divide the flow guide member 70 into multiple flow guide bodies 72. Each flow guide body is formed with the air guide channels 74. Each two adjacent flow guide bodies are interconnected by a connection section 78 under the passageway 76, (that is, the recess). Accordingly, each two adjacent flow guide bodies 72 are interconnected by a connection section 78 on one hand and have a passageway 76 therebetween on the other hand.

When playing the hockey game, the blower 50 is powered on. Please refer to FIGS. 3 and 10. The arrows in the drawings indicate the flowing direction of air. The air is collectively blown out from the air exit 52 of the blower 50 and flows into the pressure reservation space 62 through the intake manifold 64 of the air reservoir member 60. Then, the air further flows from the pressure reservation space 62 through the inlets 37 of the inner board 35 into the air space 36.

When the air is blown into the air reservoir member 60, the air is collected and concentrated in the pressure reservation space 62 to reserve wind pressure. After reserving the pressure, the air then goes into the air space 36 from the inlets 37. In this case, the air will not directly flow into the wide air space to lose wind pressure.

Figure 15:
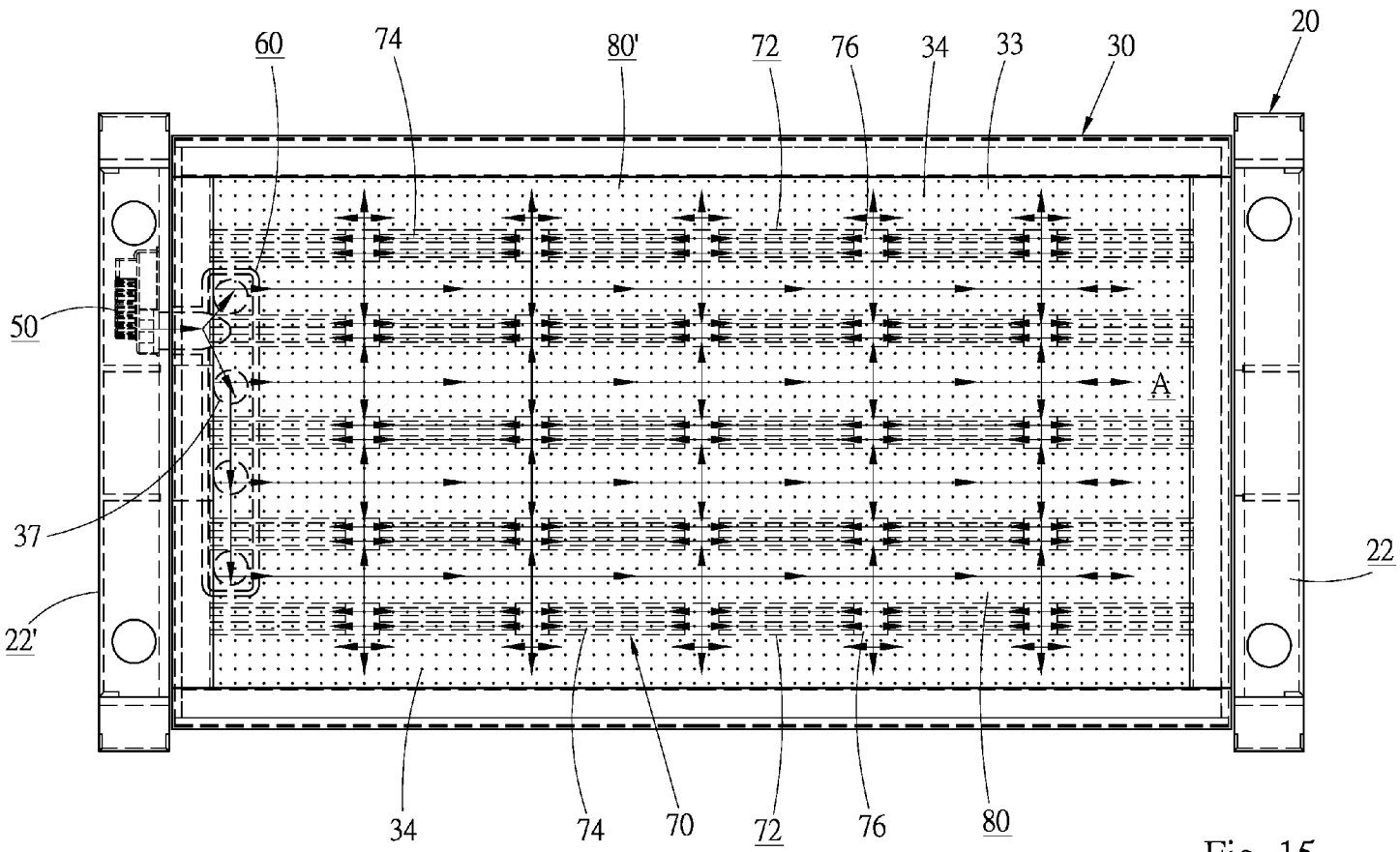
FIG. 15 is a top view of the preferred embodiment of the present invention, showing the air flowing in the game table.

Please refer to FIG. 15. After the pressure is reserved in the pressure reservation space 62, the air flows from the inlets 37 into the flow ways 80 of the air space 36 and flows along the flow ways from one end of the air space to the other end thereof. In the structure of the present invention, the adjacent flow ways 80 and flow guide units communicate with each other via multiple passageways 76, therefore, all the flow guide units and the flow ways communicate with each other to form airflow paths. Accordingly, the air in the space 36 can flow from the passageways 76 into different air guide channels 74 and flow ways 80. As shown in FIG. 15, in the air space 36, the flow guide units and the flow ways form airflow paths in every direction for guiding the air to flow efficiently without generating turbulence or causing interference. Moreover, when flowing within the flow ways 80, the passageways 76 and the air guide channels 74, the airflows are supplemented with air pressure by each other, whereby the air pressure is as unified as possible over the air space 36 to reduce pressure difference.

In this embodiment, neither of the outermost two flow ways 80' is in direct communication with any inlet 37. This design makes the air flow from the middle flow ways 80 through the passageways 76 to the outside flow ways 80' in a naturally produced circulation path. In this case, the air can circularly flow within the air space 36 and fill up the entire air space without any blind corner.

After the blower 50 has operated for a short period of time, airflows are uniformly distributed over the entire air space 36, whereby the wind pressure in every flow way 80 and every air guide channel 74 is unified. The air is then upward blown out from the flow ways 80 and the air guide channels 74 through the orifices 34 of the face board 33 to create a floating effect and reduce frictional force against the movement of the puck on the face board 33. Referring to FIG. 1, after the puck enters the wicket 301 of the hockey table face A, the puck drops into a puck collection space 221 disposed in the end frame 22. A player can then take out the puck to continue the game. The communication structure between the wicket and puck collection space pertains to prior art.

The present invention has the following advantage:

The air reservoir member 60 has the function of pressure reservation, whereby the air flowing into the air space 36 has a certain wind pressure without reducing the wind pressure. In cooperation with the inlets 37, the air reservoir member 60 systematically guides the air into the air space 36. The flow ways 80 and the flow guide units of the present invention are regularly arranged for guiding the air to regularly flow within the air space 36 at high efficiency without generating turbulence. Therefore, the air can effectively flow to all parts of the air space 36 to unify the wind pressure in the air space and provide most uniform blowing effect for the hockey table face A. Through actual tests, it is found that the present invention is better than all conventional structures in effect.

The above embodiment is only used to illustrate the present invention, not intended to limit the scope thereof. Many modifications of the above embodiment can be made without departing from the spirit of the present invention. For example, each end frame can be provided with an air-blowing member. Also, the flow guide unit can be made from a thin board, and an air guide channel is defined between two thin boards.

What is claimed is:

1. A game table with hockey game, comprising:

a table body having two end frames;

a table board, which is a rectangular frame body, two ends of the table board being pivotally connected with the two end frames, whereby the table board is rotatable between the end frames; a top face and a bottom face of the table board being respectively formed with a hockey table face and a second game table face;

at least two latch assemblies mounted between the table body and the table board for positioning the table board in a state for using the hockey table face or in another state for using the second game table face;

the hockey table face of the table board having a face board, numerous orifices being longitudinally and transversely arranged on and densely distributed over the face board; an inner board being disposed in the table board; an air space being defined between the face board and the inner board; a plurality of inlets being formed at one end of the inner board in communication with the air space;

an air-blowing member mounted in a first end frame of the table body and having an air exit;

an air reservoir member having an intake, the air reservoir member being mounted under a bottom face of the inner board, a pressure reservation space being defined between the inner board and the air reservoir member in communication with the inlets of the inner board, when the table board is positioned in the state for using the hockey table face, the air exit of the air-blowing member being in communication with the intake of the air reservoir member; and multiple flow guide units having elongated configurations, each flow guide unit having at least two flow guide bodies, a passageway being formed between each two adjacent flow guide bodies; each flow guide body being formed with at least one air guide channel in communication with the passageway; the flow guide units being arranged in the air space in rows with each air guide channel aligned with at least one row of orifices; the flow guide units partitioning the air space into multiple flow ways, the adjacent flow guide units and flow ways communicating with each other via the passageways; each inlet of the inner board communicating with one of the flow ways;

whereby air is blown out from the air exit to flow into the pressure reservation space and then flow from the pressure reservation space through the inlets of the inner board into the flow ways, the air then flowing through the passageways into the air guide channels and then flowing from the air guide channels and the flow ways through the orifices out of the face board.

2. The game table as claimed in claim 1, wherein the inlets are arranged from one side of the table board to the other side thereof; the air reservoir member being an elongated body, in which the pressure reservation space is formed, the air reservoir member covering the inlets.

3. The game table as claimed in claim 2, wherein the number of the flow ways is larger than the number of the inlets, at least one flow way is not in communication with the inlets.

4. The game table as claimed in claim 2, wherein the intake of the air reservoir member is an intake manifold, which is disposed on an edge of the air reservoir member.

5. The game table as claimed in claim 1, wherein the number of the flow ways is larger than the number of the inlets, at least one flow way is not in communication with the inlets.

6. The game table as claimed in claim 5, wherein the outermost flow way is not in communication with the inlets.

7. The game table as claimed in claim 1, wherein each flow guide unit is an elongated flow guide member, each flow guide member having at least two flow guide bodies, each two adjacent flow guide bodies being interconnected by a connection section.

8. The game table as claimed in claim 1, wherein the air-blowing member is a blower, which has an air exit.

9. The game table as claimed in claim 1, wherein the first end frame is formed with a receiving space therein; the air-blowing member is disposed in the receiving space.

10. The game table as claimed in claim 1, wherein a first vent is formed on an inner wall of the first end frame; the air exit of the air-blowing member being positioned at the first vent; a second vent being formed on an end face of the table board; the intake of the air reservoir member being positioned at the second vent; an airtight member being disposed between the first and second vents.

11. A game table with hockey game, comprising:

two end frames;

a table board, a top face and a bottom face of the table board being respectively formed with a hockey table face and a second game table face, two ends of the table board being pivotally connected with the two end frames, whereby the table board is rotatable between the end frames and is able to be positioned for using the hockey table face or the second game table face;

the hockey table face of the table board having a face board and an inner board; numerous orifices being longitudinally and transversely arranged on the face board; the inner board being disposed in the table board; an air space being defined between the face board and the inner board; the air space having at least one inlet;

an air-blowing member mounted in one of the end frames;

a pressure reservation space formed in the table board and located between the air space and the air-blowing member and in communication with the inlet, when the table board is positioned for using the hockey table face, the air-blowing member being able to blow air into the pressure reservation space; and multiple flow guide units having elongated configurations, the flow guide units being disposed in the air space to partition the air space into multiple flow ways, each flow guide unit having at least one passageway; each two adjacent flow ways communicating with each other via the passageway;

whereby the air is flow from the pressure reservation space through the inlet into the flow ways of the air space, the air then flowing from the flow ways through the orifices out of the face board.

12. The game table as claimed in claim 11, wherein each flow guide unit has at least one longitudinal air guide channel aligned with at least one row of orifices, the air guide channel and the passageway of each the flow guide unit communicating with each other.

13. The game table as claimed in claim 12, wherein each flow guide unit has at least two guide bodies, the passageway being formed between each two adjacent flow guide bodies; the air guide channel being formed on the flow guide body.

14. The game table as claimed in claim 13, wherein each two adjacent flow guide bodies of the flow guide unit are interconnected by a connection section.

15. The game table as claimed in claim 11, wherein the inner board is formed with multiple inlets, the inlets being arranged from one side of the table board to the other side thereof; the pressure reservation space being formed in an air reservoir member, the air reservoir member being disposed on the inner board and cover the inlets.

16. The game table as claimed in claim 15, wherein at least one flow way is not in communication with any inlet.

17. The game table as claimed in claim 11, wherein at least one flow way is not in communication with any inlet.

18. The game table as claimed in claim 11, further comprising at least two latch assemblies mounted between the two end frames and the table board for positioning the table board in a state for using the hockey table face or in another state for using the second game table face.

19. The game table as claimed in claim 11, wherein the air-blowing member is a blower, which has an air exit.

20. A game table with hockey game, comprising:

a table body;

a table board having a hockey table face, the table board being mounted on the table body;

the hockey table face of the table board having a face board and an inner board; numerous orifices being arranged on the face board in rows; the inner board being disposed in the table board;

an air space being defined between the face board and the inner board; the air space having at least one inlet;

an air-blowing member being mounted on one end of the table body;

a pressure reservation space formed in the table board and located between the air space and the air-blowing member and in communication with the inlet; the air-blowing member being able to blow air into the pressure reservation space; and multiple flow guide bodies being disposed in the air space in a plurality of rows; multiple flow ways being formed in the air space and alternately arranged with the multiple rows of the flow guide bodies; each row of the flow guide bodies having at least two flow guide bodies; at least two adjacent flow guide bodies arranged in a row having one passageway therebetween; each two adjacent flow ways communicating with each other via the passageway; at least one air guide channel being formed on each flow guide body in aligned with at least one row of orifices and the air guide channel communicating with the passageway.

* * * * *